United States Patent [19]

DeNigris et al.

[11] 4,071,290

[45] Jan. 31, 1978

[54] UNITARY FUSE CLIP HAVING A WIRE WRAP TERMINAL

[75] Inventors: Ernest Gerard DeNigris, Colts Neck; Albert John Tutko, Belle Mead, both of N.J.

[73] Assignees: Bell Telephone Laboratories, Incorporated, Murray Hill, N.J.; Western Electric Company, Inc., New York, N.Y.

[21] Appl. No.: 726,965

[22] Filed: Sept. 27, 1976

[51] Int. Cl.[2] ..... H01R 13/12

[52] U.S. Cl. ..... 339/258 F; 339/276 A

[58] Field of Search ..... 339/176, 220, 221, 252 F, 339/253 F, 258, 259 F, 276 A

[56] References Cited

U.S. PATENT DOCUMENTS

| | | | |
|---|---|---|---|
| 2,229,989 | 1/1941 | Roby | 339/258 F |
| 2,911,609 | 11/1959 | Burtt et al. | 339/176 MP |
| 3,555,497 | 1/1971 | Watanable | 339/258 R |
| 3,760,340 | 9/1973 | Friend | 339/262 R |
| 3,824,557 | 7/1974 | Mallon | 339/258 R |
| 3,953,096 | 4/1976 | Williams | 339/17 L |
| 4,002,399 | 1/1977 | Deitch | 339/221 M |

*Primary Examiner*—Joseph H. McGlynn
*Attorney, Agent, or Firm*—David H. Tannenbaum

[57] ABSTRACT

A spring tension fuse clip is disclosed having a wire wrap leg formed integrally with the spring clip. The clip is formed from a single piece of material having a gauge heavy enough to satisfy the wire wrap terminal requirement while at the same time satisfying the spring tension fuse clip requirement. This result is achieved by coining the clip only at certain bends to reduce the spring tension to the desired amount. The clip is mounted to a flat surface by a locking tab on the wire wrap leg.

3 Claims, 5 Drawing Figures

UNITARY FUSE CLIP HAVING A WIRE WRAP TERMINAL

FIELD OF THE INVENTION

This invention relates to a spring tension fuse clip for supporting and making electrical contact with an elongated type of fuse.

BACKGROUND OF THE INVENTION

Clips for holding fuses in place are well known in the art. Typically, such clips are mounted on a flat plate by a screw or rivet and the clip applies spring tension to the electrical terminals of the fuse. Electrical connection to the fuse clip is made by connecting an electrical wire to the clip, usually by means of a screw terminal or solder connection. In the typical clips assembly no wrap provision is available and in fact none is feasible except via two piece construction.

While nonwire wrap clips are in widespread use, a desirable alternative, especially from a manufacturing cost standpoint, is the manufacture of the spring clip employing a wire wrap terminal and constructed from a unitary piece of conductive material. However, a problem with such an arrangement is presented in that the wire wrap terminal, in order to achieve proper electrical and mechanical contact, must have a cross-section which, when bent to accept the fuse, results in a spring tension against an inserted fuse of such a magnitude that removal of the fuse becomes difficult. When the material gauge is reduced in thickness an amount necessary to achieve proper spring tension, the material becomes too thin to allow proper electrical and mechanical contact to the wire wrap terminal.

Thus, it is an object of our invention to provide an easily manufactured unitary spring clip which meets both the fuse spring tension requirements and the wire wrap terminal requirements.

It is another object of our invention to provide a fuse clip that is manufacturable from a single piece of material, the fuse clip having both the proper spring tension for releasably retaining a fuse and the proper physical dimensions for supporting a wire wrap electrical connection, while at the same time being self-locking to a supporting base.

SUMMARY OF THE INVENTION

We have developed a fuse clip for supporting and making electrical connection with a tubular push-in lock type fuse, the clip being formed from a single piece of material having a gauge thick enough to satisfy the wire wrap terminal requirements while at the same time satisfying the fuse clip spring tension requirements. This result is achieved by reducing the thickness of the material only where the material is bent to form the U of the clip. This reduction in thickness, a process called coining, serves to reduce the spring tension the desired amount without either affecting the physical size of the wire wrap leg or the structural resistivity of the clip. The clip is mounted through a hole in a flat surface by a locking tab on the wire wrap leg. A second shorter leg integral with the fuse clip is used for positional stability. Because of the locking tabs the fuse clip mounts to the flat panel without additional hardware thereby substantially reducing manufacturing costs.

Thus, it is one feature of our invention that a spring clip is formed from a single piece of material, using the coining process to reduce the spring tension of the clip portion to the desired level.

It is another feature of our invention that an easily manufacturable and easily installable fuse clip is available having a wire wrap leg having the physical size for proper electrical contact with a wrapped electrical wire and having proper spring tension pressure on an inserted fuse terminal, the fuse clip being constructed from a single piece of unitary gauge material.

BRIEF DESCRIPTION OF THE DRAWING

The principles of our invention, as well as additional objects and features thereof will be more fully understood from a review of the drawing in which.

DETAILED DESCRIPTION

Figure 1:
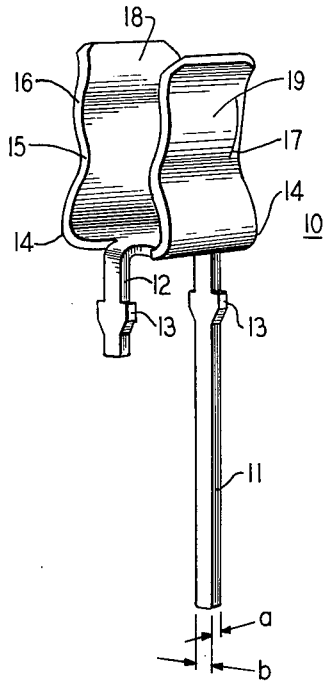
FIG. 1 shows the fuse clip.
Figure 5:
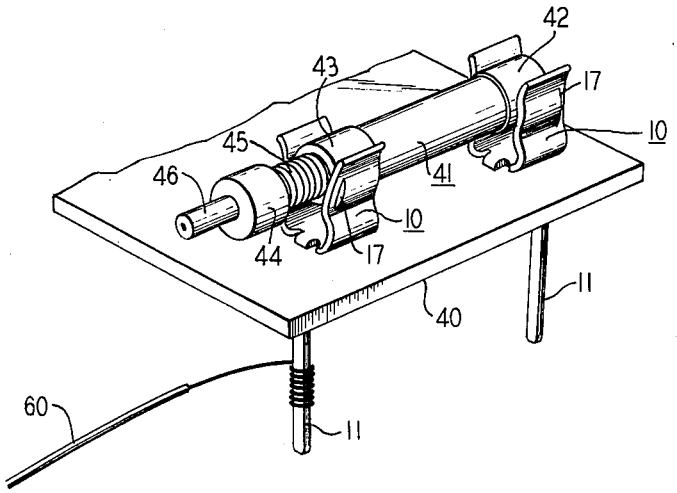
FIG. 5 shows a pair of fuse clips holding a tubular fuse.

As shown in FIG. 1 the fuse clip is bent in the form of a U with the sides 18 and 19 of the U formed to accept a tubular type fuse, such as the type of fuse 41 shown in FIG. 5. The fuse clip side portions 18 and 19 of the U are formed inward at points 15 and 16 to create an outwardly curved section therebetween to accept the inserted fuse. The sides of the clips at positions 15 and 16 supply inward pressure on the electrical terminals 43 and 42 of an inserted fuse to hold the fuse in position and for proper electrical contact. This inward pressure is created by the bending of the clip at points 14. In order to control the amount of the inward pressure, and thus control the insertion and extraction forces of the fuse, points 14 are coined so as to remove some material from the cross section of the clip. In this manner a unitary piece of material can be used both for the clip and for wire wrap leg 11, so that the wire wrap leg will meet the physical dimensions for proper electrical contact to the wire which is wrapped around the leg in the manner shown in FIG. 5.

Fuse clip 10 is shown having locking tab 13 constructed along wire wrap leg 11 so that when the wire wrap leg is inserted through a hole in a mounting board, as shown in FIG. 5, the clip locks in place. Short leg 12, with locking tab 13, is used to provide mechanical stability for mounting purposes.

Slots 17 in side portions 18 and 19 form an inward detent and serve to hold an inserted fuse in position and to prevent the fuse from moving backward or forward. This aspect will be discussed in more detail hereinafter. Dimension *a* is typically 0.030 while dimension *b* is typically 0.060.

Figure 2:
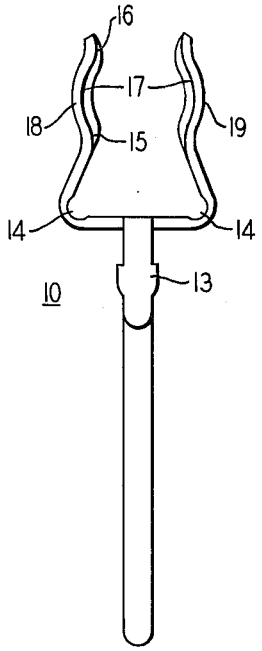
FIG. 2 shows the fuse clip viewed from one open side of the clip.

In FIG. 2 the curves of side portions 18 and 19 of the U of the fuse clip can be seen to form portions of a curve between points 15 and 16 designed to accept the electrical contact portion of the inserted fuse. These side portions exert inward pressure, due to the bending of the material at bends 14 of either side of the U. As discussed, the amount of the inward pressure, and hence the amount of the holding force is determined by the combination of the material used and the thickness of the material at bends 14. Since a unitary gauge material is used the inward spring tension force is controlled by the thickness of the material at bends 14, which thickness is less than the overall thickness of the material throughout the remainder of the fuse clip. During manufacture of the fuse clip the thickness at points 14 is reduced by the process of coining, which in effect flattens the material in a given location.

Figure 3:
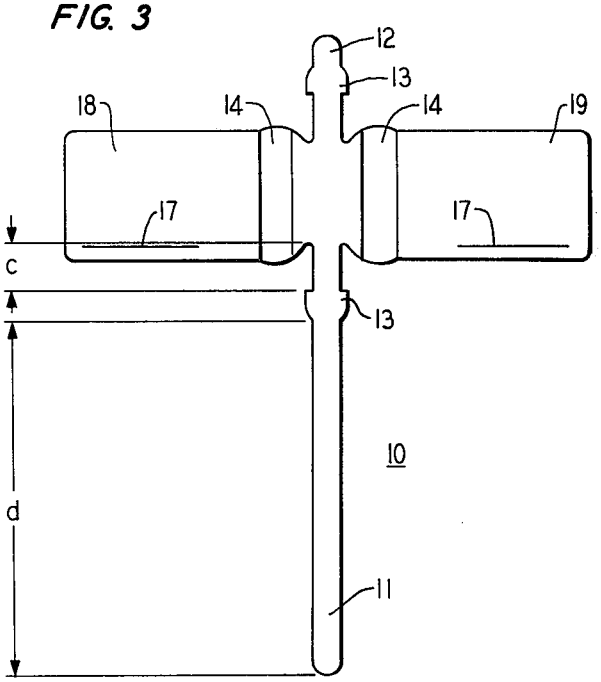
FIG. 3 shows a top view of the unitary structure prior to bending.

In FIG. 3 there is shown a fuse clip prior to bending. Wire wrap leg 11 extends from one side of the main body of the fuse clip, while short leg 12 extends from the opposite side of the clip body. Distance *c* between the top of locking tabs 13 and the base of the spring clip is determined by the thickness of the material through which it will be mounted. Typically this distance is 1/10 of an inch. Length *d* of wire wrap leg 11 is typically 8/10 of an inch measured from the bottom of locking tab 13.

Figure 4:
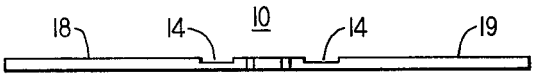
FIG. 4 shows a side view of the unitary structure prior to bending.

In FIG. 4 a side view of the U portion of the clip is shown prior to bending. Areas 14 are made by coining the clip prior to bending. For proper spring tension this thickness should be 0.020 when using beryllium copper alloy 172 annealed.

The manufacturing process, which depending on the tooling can take more or less steps to achieve, is basically as follows. Starting with a single piece of material, such as beryllium copper alloy 172 annealed, punching slots 17; then cutting or punching the basic shape shown in FIG. 3; then coining the basic shape at points 14; then prebending to achieve bends 15 and 16 and the top outwardly curved bend; then bending sides 18 and 19 to form the U shape; and then bending legs 11 and 12 to form the wire wrap and locking legs. The manufacturing process used to achieve the fuse clip could be where a strip of material is indexed past several stations, each station performing a step of the process. In such a situation, depending on the size of the machine and upon the design of the tooling, the number of steps required to manufacture the fuse clip can be more or less than the steps described above.

In FIG. 5 there is shown mounting board 40 having holes punched therein to accept legs 11 and 12 of the fuse clip 10. Two fuse clips are used to hold each fuse and are mounted on board 40 along the longitudinal axis of the fuse in a position relative to each other such that one fuse clip contacts electrical terminal 43 of the fuse, while the other of the pair of fuse clips contacts electrical terminal 42 of the same fuse. Slot 17 in the forward fuse clip prevents the inserted fuse from moving forward, while slot 17 in the rearmost fuse clip prevents the inserted fuse from moving backward. Note that both of these fuse clips are identical to each other, but that the rearmost clip is mounted on the board in a reverse manner from the forwardmost clip so that slots 17 may be properly located with respect to the inserted fuse. One application of the fuse clip is shown in our concurrently filed copending patent application, Ser. No. 726,966, which is incorporated herein by reference.

What is claimed is:

1. A spring tension fuse clip having a wire wrap leg formed integrally with the spring clip and having a U shape adapted for mating with and applying spring tension to one electrical terminal of an inserted fuse, said clip being formed from a single piece of electrically conductive material having a first gauge, said U shape having two side portions and a lower portion, said side portions bent upward from said lower portion, wherein the material only within the bends formed between said side portions and said lower portion of said U is reduced in gauge so as to reduce the spring tension of said clip against an inserted fuse.

2. The invention set forth in claim 1 wherein said first gauge is thick enough to form a wire wrap leg having a diagonal cross-sectional area greater than 0.059 but not to exceed 0.073.

3. The invention set forth in claim 1 wherein said fuse clip has a second leg formed integrally with the fuse spring clip, said wire wrap leg and said second leg having formed thereon locking tabs.

* * * * *